US005904882A

United States Patent [19]

Featherly

[11] Patent Number: 5,904,882

[45] Date of Patent: May 18, 1999

[54] PERSONAL TRAVEL COOL AIR HUMIDIFIER

[76] Inventor: Robert J. Featherly, 1438 Havenhill Dr., New Port Richey, Fla. 34655

[21] Appl. No.: 09/001,430

[22] Filed: Dec. 31, 1997

[51] Int. Cl.[6] ..... B01F 3/04

[52] U.S. Cl. ..... 261/30; 261/119.1

[58] Field of Search ..... 261/24, 30, 119.1

[56] References Cited

U.S. PATENT DOCUMENTS

| | | | |
|---|---|---|---|
| 1,042,055 | 10/1912 | Theisen | 261/119.1 |
| 1,567,957 | 12/1925 | Kesselman | 261/30 |
| 1,573,262 | 2/1926 | McDevitt | 261/30 |
| 1,779,679 | 10/1930 | Offen | 261/30 |
| 2,054,200 | 9/1936 | Langford | 261/30 |
| 2,119,207 | 5/1938 | Gibbs | 261/119.1 |
| 2,399,862 | 5/1946 | Feldermann | 261/30 |
| 2,741,004 | 4/1956 | Williams | 261/30 |
| 2,967,051 | 1/1961 | Mobley | 261/30 |
| 3,633,881 | 1/1972 | Yurdin | 261/24 |
| 4,035,451 | 7/1977 | Tringali | 261/30 |
| 5,076,972 | 12/1991 | Lu | 261/24 |

FOREIGN PATENT DOCUMENTS

| | | | |
|---|---|---|---|
| 3201470 | 8/1982 | Germany | 261/30 |
| 436769 | 6/1948 | Italy | 261/30 |
| 765612 | 1/1957 | United Kingdom | 261/30 |

*Primary Examiner*—C. Scott Bushey

[57] ABSTRACT

A portable humidifier is provided including a container having a predetermined amount of water situated therein. Also included is a plate with at least one inlet vent and at least one outlet vent formed therein. The plate is removably situated over the container. The humidifier further includes a fan positioned adjacent the inlet vent for effecting the flow of air through the inlet vent, in communication with the water and subsequently through the outlet vent.

1 Claim, 2 Drawing Sheets

PERSONAL TRAVEL COOL AIR HUMIDIFIER

BACKGROUND OF THE INVENTION

1. Field of the Invention

The present invention relates to humidifiers and more particularly pertains to a new personal travel cool air humidifier for humidifying cool air in a hotel room or the like.

2. Description of the Prior Art

The use of humidifiers is known in the prior art. More specifically, humidifiers heretofore devised and utilized are known to consist basically of familiar, expected and obvious structural configurations, notwithstanding the myriad of designs encompassed by the crowded prior art which have been developed for the fulfillment of countless objectives and requirements.

Known prior art humidifiers include U.S. Pat. No. 5,324,230; U.S. Pat. No. 5,250,232; U.S. Pat. No. 5,131,070; U.S. Pat. No. Des. 330,074; U.S. Pat. No. Des. 335,340; and U.S. Pat. No. Des. 336,511.

In these respects, the personal travel cool air humidifier according to the present invention substantially departs from the conventional concepts and designs of the prior art, and in so doing provides an apparatus primarily developed for the purpose of humidifying coot air in a hotel room or the like.

SUMMARY OF THE INVENTION

In view of the foregoing disadvantages inherent in the known types of humidifiers now present in the prior art, the present invention provides a new personal travel cool air humidifier construction wherein the same can be utilized for humidifying cool air in a hotel room or the like.

The general purpose of the present invention, which will be described subsequently in greater detail, is to provide a new personal travel cool air humidifier apparatus and method which has many of the advantages of the humidifiers mentioned heretofore and many novel features that result in a new personal travel cool air humidifier which is not anticipated, rendered obvious, suggested, or even implied by any of the prior art humidifiers, either alone or in any combination thereof.

To attain this, the present invention generally comprises a cup having a circular bottom face and a cylindrical side wall integrally coupled to a periphery of the bottom face. Such side wall extends upwardly from the bottom face to define an interior space and an upper peripheral lip. The upper peripheral lip has a plurality of threaded grooves formed in an interior surface thereof. As such, the cup is adapted to contain a predetermined amount of water therein. Further provided is a humidifier including a circular plate with a planar top face, a planar bottom face and a circular periphery formed therebetween. As shown in FIGS. 1 & 2, the plate has a plurality of spaced parallel linear outlet vents formed therein adjacent to the periphery thereof. Associated therewith is a plurality of spaced parallel linear inlet vents formed therein adjacent to the periphery thereof. The inlet vents are positioned on a side of the plate diametrically opposite the outlet vents. As shown in FIG. 3, the bottom face has an annular flange integrally coupled thereto and extended downwardly therefrom. A plurality of threaded grooves are formed in an outer surface of the flange for being screwably coupled with the threaded grooves of the cup. The top face of the plate has a housing mounted thereon over the inlet vents. The housing has a top face and a periphery coupled between the top face of the plate and the top face of the housing. The top face of the housing has a plurality of spaced parallel linear inlet vents in communication with those of the circular plate. A motor is situated within an interior space of the housing with the rotor thereof extending downwardly through the plate where it is coupled to a fan. A switch is mounted to the periphery of the housing. Such switch is connected between the motor and a battery within the housing for selectively effecting the rotation of the fan. By this structure, air is circulated through the inlet vents, in communication with the water and subsequently through the outlet vents.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal travel cool air humidifier apparatus and method which has many of the advantages of the humidifiers mentioned heretofore and many novel features that result in a new personal travel cool air humidifier which is not anticipated, rendered obvious, suggested, or even implied by any of the prior art humidifiers, either alone or in any combination thereof.

It is another object of the present invention to provide a new personal travel cool air humidifier which may be easily and efficiently manufactured and marketed.

It is a further object of the present invention to provide a new personal travel cool air humidifier which is of a durable and reliable construction.

An even further object of the present invention is to provide a new personal travel cool air humidifier which is susceptible of a low cost of manufacture with regard to both materials and labor, and which accordingly is then susceptible of low prices of sale to the consuming public, thereby making such personal travel cool air humidifier economically available to the buying public.

Still yet another object of the present invention is to provide a new personal travel cool air humidifier which provides in the apparatuses and methods of the prior art some of the advantages thereof, while simultaneously overcoming some of the disadvantages normally associated therewith.

Still another object of the present invention is to provide a new personal travel cool air humidifier for humidifying cool air in a hotel room or the like.

Even still another object of the present invention is to provide a new personal travel cool air humidifier that includes a container having a predetermined amount of water situated therein. Also included is a plate with at least one inlet vent and at least one outlet vent formed therein. The plate is removably situated over the container. The humidifier further includes a fan positioned adjacent the inlet vent for effecting the flow of air through the inlet vent, in communication with the water and subsequently through the outlet vent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
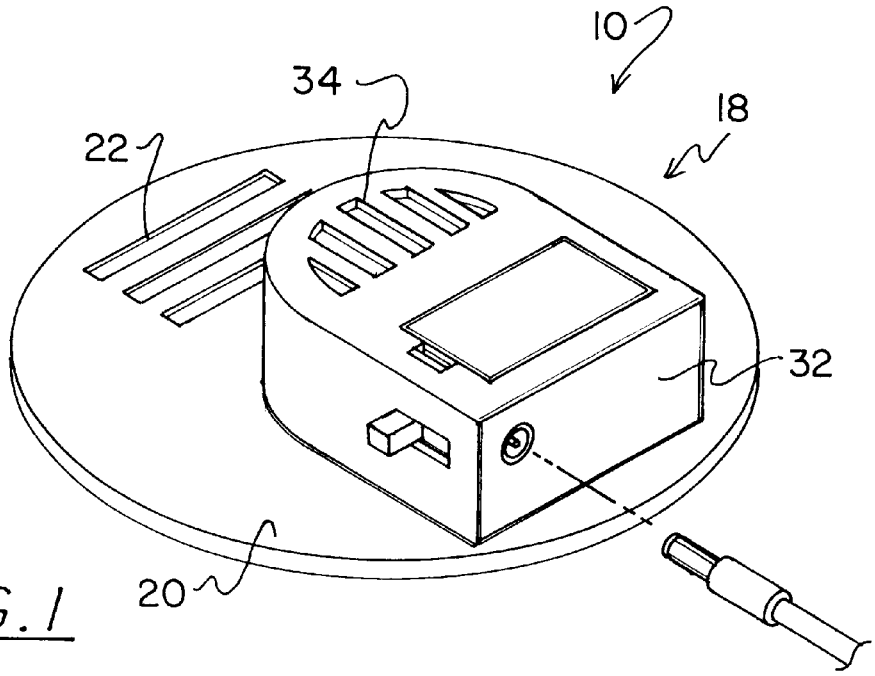
FIG. 1 is a perspective view of a new personal travel cool air humidifier according to the present invention.

With reference now to the drawings, and in particular to FIGS. 1 through 4 thereof, a new personal travel cool air humidifier embodying the principles and concepts of the present invention and generally designated by the reference numeral 10 will be described.

The present invention, designated as numeral 10, includes a 16 ounce cup 12 having a circular bottom face and a cylindrical side wall integrally coupled to a periphery of the bottom face. Such side wall extends upwardly from the bottom face to define an interior space and an upper peripheral lip. The upper peripheral lip has a plurality of threaded grooves 14 formed in an interior surface thereof. As such, the cup is adapted to contain a predetermined amount of water therein. Preferably, the container is clear to indicate the amount of water therein. Further, a weight 16 may be situated within the bottom face for preventing tipping.

Figure 2:
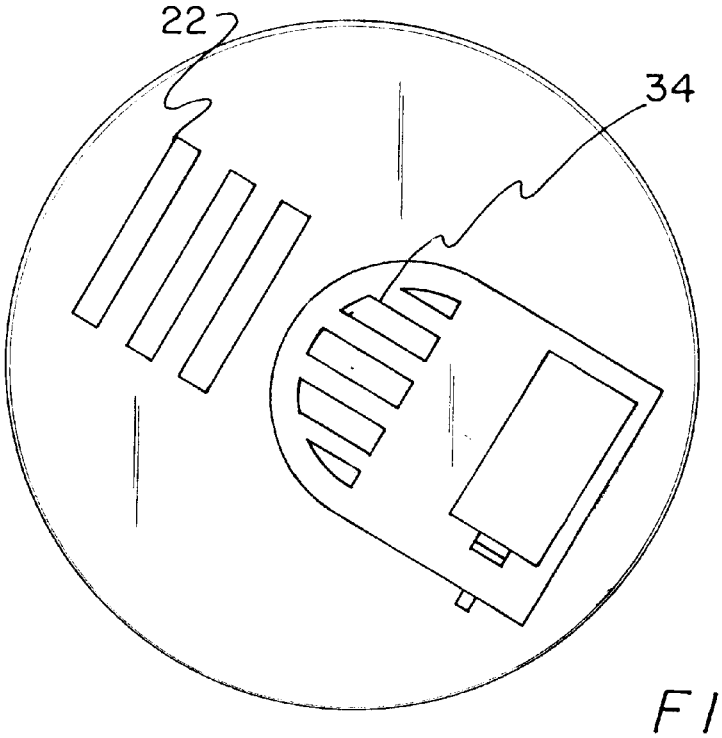
FIG. 2 is a top view of the present invention.

Further provided is a humidifier 18 including a circular plate 20 with a planar top face, a planar bottom face and a circular periphery formed therebetween. As shown in FIGS. 1 & 2, the plate has a plurality of spaced parallel linear outlet vents 22 formed therein adjacent to the periphery thereof. Associated therewith is a plurality of spaced parallel linear inlet vents 24 also formed in the plate adjacent to the periphery thereof. The inlet vents are positioned on a side of the plate diametrically opposite the outlet vents.

Figure 3:
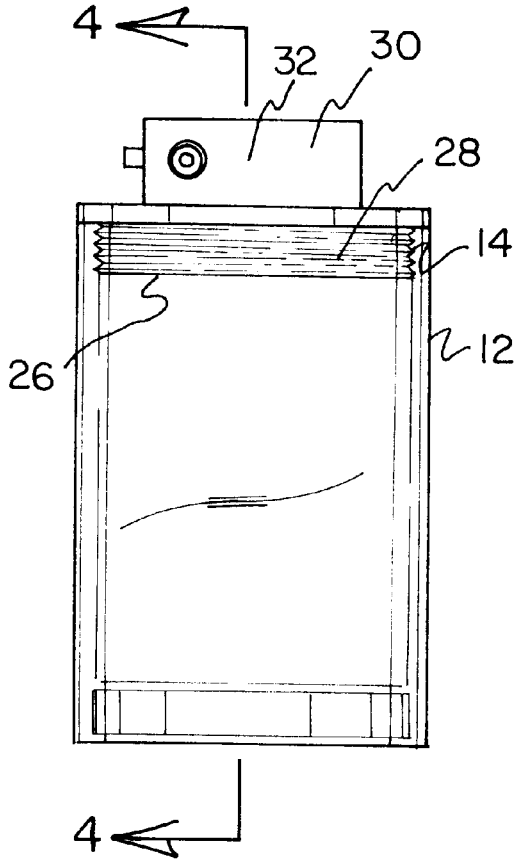
FIG. 3 is a side view of the present invention.

As shown in FIG. 3, the bottom face has an annular flange 26 integrally coupled thereto and extended downwardly therefrom. A plurality of threaded grooves 28 are formed in an outer surface of the flange for being screwably coupled with the threaded grooves of the cup. In the alternative, the container may comprise of a conventional cup and the circular plate may simply rest thereon without an associated flange.

Figure 4:
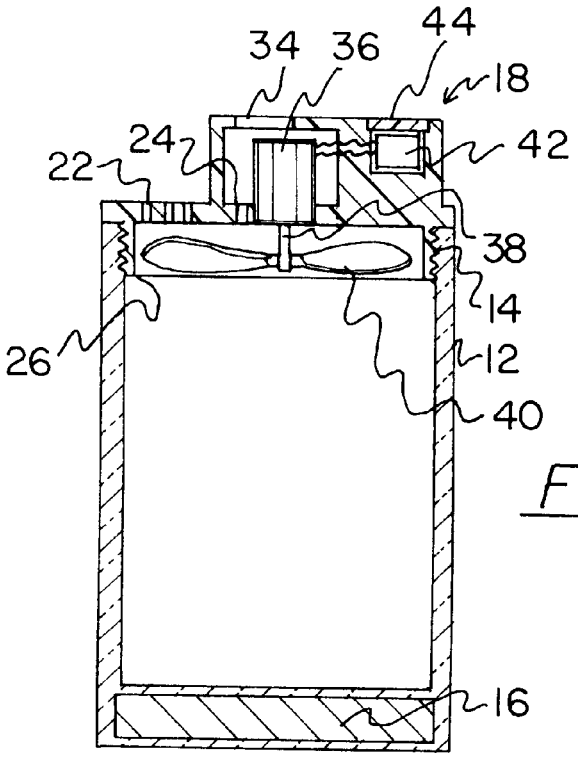
FIG. 4 is a cross-sectional view of the present invention taken along line 4—4 shown in FIG. 3.

The top face of the plate has a housing 30 mounted thereon over the inlet vents. The housing has a top face and a periphery 32 coupled between the top face of the plate and the top face of the housing. The top face of the housing has a plurality of spaced parallel linear inlet vents 34 in communication with those of the circular plate, as shown in FIG. 4. A motor 36 is situated within an interior space of the housing with the rotor 38 thereof extending downwardly through the plate where it is coupled to a fan 40. In an alternate embodiment, the entire fan is of a reduced size and resides within the interior space of the housing.

A switch is mounted to the periphery of the housing. Such switch is connected between the motor and a battery 42 within the housing for selectively effecting the rotation of the fan. A lid 44 is removably mounted on the top face of the housing for allowing access to the battery. As an option, a jack may be included on the housing for releasably coupling with an alternating current power source. By this structure, air is circulated through the inlet vents when the fan is actuated. Upon the entry of the air within the container, the same flows in communication with the water and subsequently through the outlet vents for humidifying a room.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable humidifier comprising, in combination:

a cup constructed from a clear material having a circular bottom face and a cylindrical side wall integrally coupled to a periphery of the bottom face and extending upwardly therefrom to define an interior space and an upper peripheral lip having a plurality of threaded grooves formed in an interior surface thereof, whereby the cup is adapted to contain a predetermined amount of water therein;

a weight mounted within the bottom face of the cup for preventing the same from tipping; and a humidifier including a circular plate with a planar top face, a planar bottom face and a circular periphery formed therebetween, the plate having a plurality of spaced parallel linear outlet vents formed therein adjacent to the periphery thereof and a plurality of spaced parallel linear inlet vents formed therein adjacent to the periphery thereof on a side of the plate diametrically opposite the outlet vents, the bottom face having an annular flange integrally coupled thereto in spaced relationship with the periphery of the circular plate and extending downwardly therefrom with a plurality of threaded grooves formed therein for being screwably coupled with the threaded grooves of the cup, the top face of the plate having a housing mounted thereon over the inlet vents, the housing having a top face with a substantially circular portion and a substantially rectangular portion and a periphery coupled between the top face of the plate and the top face of the housing, the top face of the housing having a plurality of spaced parallel linear inlet vents, a motor mounted to the circular plate such that the motor is situated within an interior space of the housing with the rotor thereof extending downwardly through the plate where it is coupled to a fan which is encompassed by the annular flange, a switch mounted to the periphery of the housing and connected between the motor and a battery within the housing for selectively effecting the rotation of the fan, whereby air is circulated through the inlet vents, in communication with the water and subsequently through the outlet vents;

wherein the top face of the housing has a lid mounted thereon for allowing selective access to the battery.

* * * * *